US006851270B2

(12) United States Patent
Denvir

(10) Patent No.: US 6,851,270 B2
(45) Date of Patent: Feb. 8, 2005

(54) INTEGRATED REFRIGERATION CONTROL

(75) Inventor: Kerry J. Denvir, Boston, MA (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/457,605

(22) Filed: Jun. 9, 2003

(65) Prior Publication Data

US 2004/0244389 A1 Dec. 9, 2004

(51) Int. Cl.[7] ..... F25D 21/00
(52) U.S. Cl. ..... 62/234; 62/154; 62/155
(58) Field of Search ..... 62/151, 154, 155, 62/156, 80, 234

(56) References Cited

U.S. PATENT DOCUMENTS

| | | | | | |
|---|---|---|---|---|---|
| 3,839,878 | A | * | 10/1974 | Tilmanis | 62/155 |
| 4,604,871 | A | * | 8/1986 | Chiu et al. | 62/136 |
| 4,843,833 | A | * | 7/1989 | Polkinghorne | 62/180 |
| 4,858,443 | A | * | 8/1989 | Denpou | 62/126 |
| 4,879,878 | A | * | 11/1989 | Polkinghorne | 62/187 |
| 4,938,027 | A | * | 7/1990 | Midlang | 62/80 |
| 5,415,005 | A | * | 5/1995 | Sterber et al. | 62/154 |
| 5,433,086 | A | * | 7/1995 | Cho et al. | 62/455 |
| 5,488,834 | A | | 2/1996 | Schwarz | |
| 5,539,608 | A | * | 7/1996 | Hurley et al. | 361/152 |
| 5,555,736 | A | * | 9/1996 | Wills et al. | 62/187 |
| 5,743,099 | A | * | 4/1998 | Kraynak et al. | 62/150 |
| 6,248,983 | B1 | * | 6/2001 | Yamanoi | 219/501 |
| 6,497,108 | B2 | * | 12/2002 | Collins et al. | 62/155 |
| 6,739,146 | B1 | * | 5/2004 | Davis et al. | 62/155 |

FOREIGN PATENT DOCUMENTS

JP 408261629 A * 10/1996

* cited by examiner

*Primary Examiner*—William E. Tapolcai
*Assistant Examiner*—Mohammad M. Ali
(74) *Attorney, Agent, or Firm*—Russell E. Baumann; Frederick J. Telecky, Jr.

(57) ABSTRACT

An integrated refrigeration control (IRC) module is disclosed which combines both thermal and electrical protection to the main components of a refrigerator and uses sensor inputs to control the compressor. The IRC module employs triacs (Q2, Q4, Q6, Q8, Q10) to control power to the start and run windings of the compressor motor, evaporator and compressor fans and the defrost heater. The module adaptively controls the refrigerator defrost cycle using pervious defrost cycle run times to determine new cumulative compressor run times. Also disclosed is the use of preventive defrost periods performed for brief periods at intervals between portions of the cumulative compressor run time.

6 Claims, 8 Drawing Sheets

INTEGRATED REFRIGERATION CONTROL

FIELD OF THE INVENTION

This invention relates generally to refrigerators and freezers and more particularly to defrost cycle controllers therefor.

BACKGROUND OF THE INVENTION

Refrigeration and freezer systems, especially of the home appliance type, provide cooled air to food storage enclosures. Air is blown over heat exchangers which extract heat from the air to produce the cooled air. The heat exchangers generally operate on the known cooling effect provided by gas that is expanded in a closed circuit, i.e., the refrigeration cycle. In order to be expanded, the gas is first compressed in a compressor. As is known, the efficiency of a system can be enhanced by reducing the amount of frost that builds up on the heat exchanger. Present new systems generally are of a self-defrosting type, i.e., they employ a heater specially positioned and controlled to provide sufficient heat to the enclosure to cause melting of frost build-up on the heat exchanger. Such defrost heaters are controlled by various defrost cycle algorithms and configurations.

Refrigeration and freezer systems have two general cycles or modes, a cooling cycle or mode and a defrost cycle or mode. During the cooling cycle, the compressor is connected to line voltage and the compressor is cycled on and off by means of a thermostat. The compressor is actually run only when the enclosure warms to a preselected temperature. During the defrost cycle, the compressor is disconnected from line voltage and instead, a defrost heater is connected to line voltage. The defrost heater is turned off by means of a temperature responsive switch, after the build-up frost has been melted away.

According to the prior art, operation of the compressor and defrost heater is controlled using a defrost cycle controller generally by one of several techniques referred to herein as real or straight time, cumulative time and variable time. According to real time, the connection of the system to line voltage is monitored and the interval between defrost cycles is based on a fixed interval of real time. Cumulative time involves monitoring the cumulative time a compressor is run during a cooling cycle with the interval between defrost cycles varied based on the cumulative time the compressor is run. Variable time involves allowing for variable intervals between defrost cycles by monitoring both cumulative compressor run time as well as continuous compressor run time and defrost cycle length. The interval between defrost cycles then is based more closely on the need for defrosting.

Defrost systems as described above use more energy than is needed to prevent excessive frost build-up which prevents efficient cooling.

SUMMARY OF THE INVENTION

An object of the present invention is the provision of a refrigeration control having improved efficiency in operating the defrost heater. Another object is the provision of a lower cost refrigeration control and one which is more adaptable for use with different compressors and other ancillary components. Yet another object is the provision of a refrigeration control which overcomes the limitations noted above of the prior art.

Briefly, in accordance with the invention, an integrated refrigeration controller for use in a refrigeration system having a compressor, an evaporator, a freezer compartment and a defrost heater comprises a microprocessor, a first temperature sensor thermally coupled to the freezer compartment and having a signal fed to the microprocessor, a second temperature sensor thermally coupled to the evaporator and having a signal fed to the microprocessor, an electronic switch for connecting the defrost heater to a voltage source and a zero-crossing network coupled to the voltage source and having an input to the microprocessor. The microprocessor is programmed to monitor the temperature responsive signals and based on such signals and zero-crossing detection to energize the electronic switch to thereby provide power to the defrost heater.

According to a feature of the invention, the control monitors the previous on time on the defrost heater based on that time adaptively determines the defrost heater off time for the next cycle. According to a modified embodiment, the defrost heater is energized for short periods of time at preselected full or part energy level at selected intervals of time during what normally would be the normal compressor run time to thereby limit or prevent the build-up of frost and concomitantly shorten the defrost cycle. According to another feature of the invention, preferably the defrost cycles are initiated at the end of a warming cycle to take advantage of ambient warming effects.

BRIEF DESCRIPTION OF THE DRAWINGS

Other objects, advantages and details of the integrated refrigeration control of the invention appear in the following detailed description referring to the drawings in which.

DETAILED DESCRIPTION OF PREFERRED EMBODIMENTS

Figure 1:
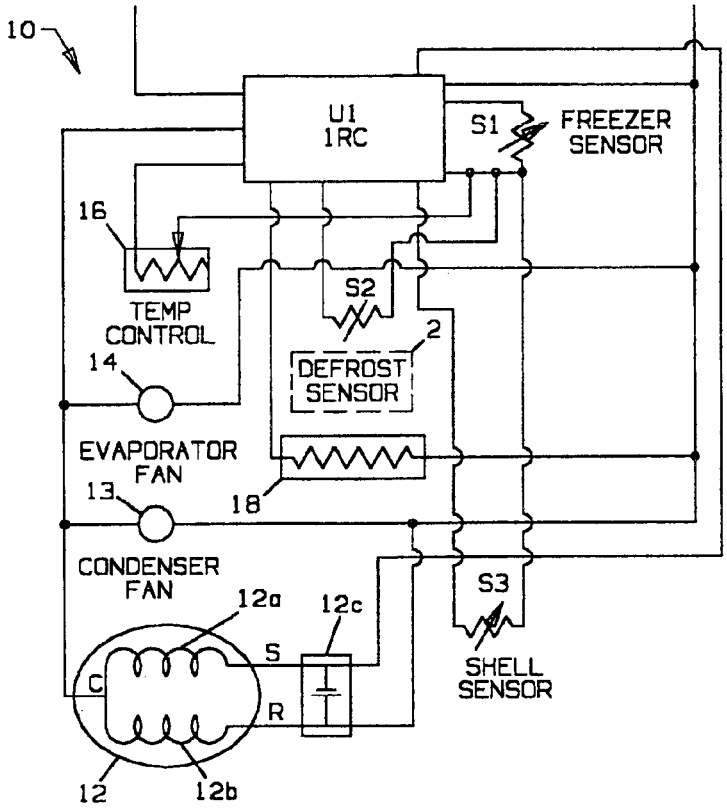
FIG. 1 is a schematic diagram showing an IRC module made in accordance with the invention along with a wiring diagram of a refrigerator controlled by the module.
Figure 2:
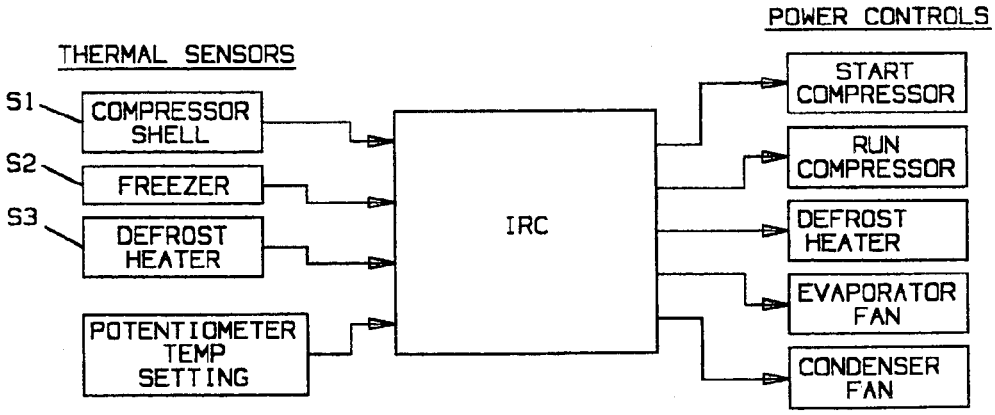
FIG. 2 is a schematic diagram showing an IRC module along with sensor inputs and control outputs.

With particular reference to FIGS. 1 and 2, in accordance with a preferred embodiment, an integrated refrigeration control system 10 comprises a compressor 12 having a start winding 12*a* and run winding 12*b* with an optional run capacitor 12*c* across lines connected to s (start winding) and r (run winding). The compressor motor is controlled by a microprocessor U1 of control module IRC, to be discussed in detail below. The IRC module also controls a compressor fan 13 and evaporator fan 14 along with a defrost heater 18.

Inputs to the IRC module include thermal sensor S1 for a freezer compartment 2, a defrost thermal sensor S2 positioned in good heat conductive relation with the evaporator and preferably a thermal sensor S3 in good heat conductive relation with the shell of the compressor. The thermal sensors employed are NTC thermistors which provide temperature signals used by the IRC module to perform thermal protection (S3), cold control (S1) and adaptive defrost control functions (S2). It will be understood that other types of sensors, such as PTC, could be used, if desired. Another input to the IRC module is a user controlled cold control 16 shown in the form of a potentiometer in order to control the freezer temperature setting.

Figure 3:
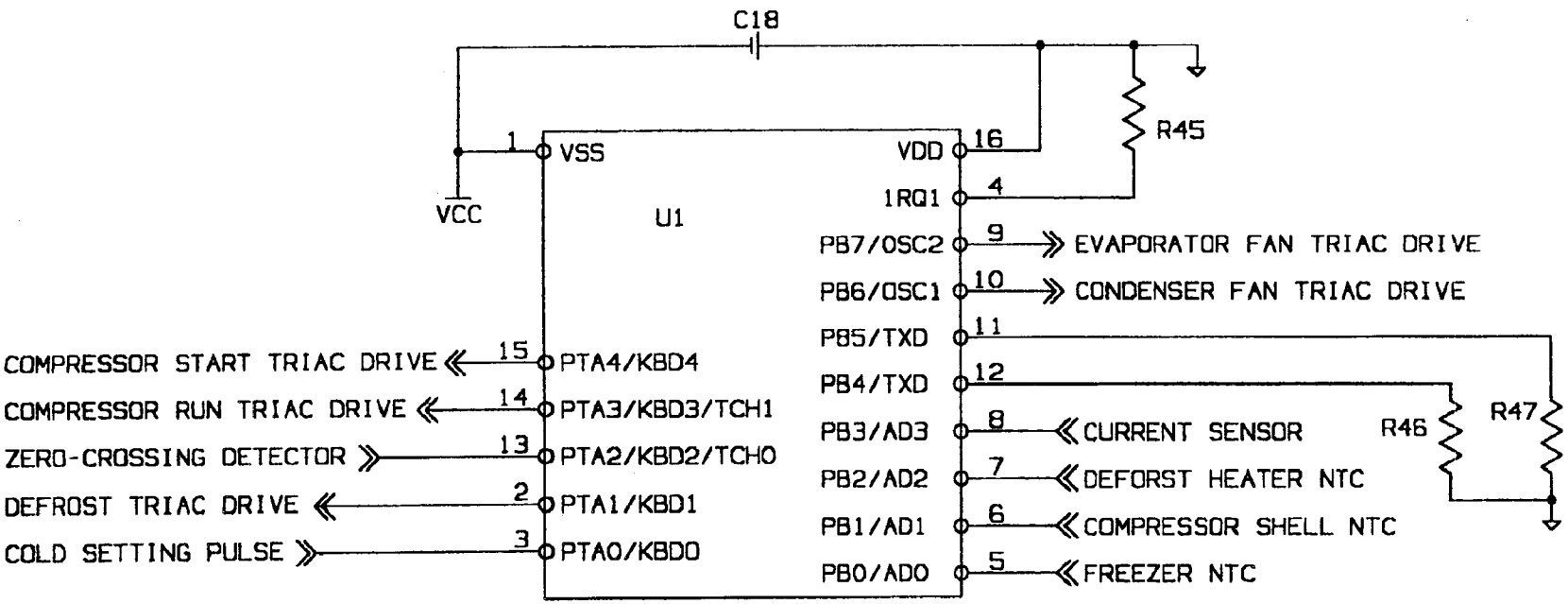
FIG. 3 shows a microprocessor used in the IRC module and connections to the microprocessor, FIGS. 4A and 4B taken together show a schematic wiring diagram of a power connector and interconnected triac drives, a zero-crossing detection network and a power supply.

With reference to FIG. 3, the IRC module controls the temperature of the freezer compartment using two input signals, one corresponding to the temperature of the freezer compartment, PBO, and the other, PTAO, corresponding to the desired temperature setting. The freezer compartment temperature is controlled by comparing the actual freezer temperature to the desired setting. If the temperature rises higher than the setting, the IRC module independently provides power to the main PTA3 and start PTA4 windings of the compressor motor. The IRC module then de-energizes the start winding after a selected period. The module independently energizes the evaporator and compressor fans through lines PB7, PB6 respectively.

The IRC module is programmed so that for each desired temperature setting there is a programmed temperature at which the compressor is turned on and a corresponding programmed temperature at which it is turned off.

The IRC module protects the compressor motor by sensing the current flowing through the compressor windings and cutting power to the motor when certain fault conditions are detected. The current overload threshold is programmed so that the main winding current is compared to a selected level and power is removed from the compressor motor within a preselected interval. The IRC module independently controls power to the fan motors while the motor is in the tripped state.

Excessive motor temperatures are monitored by the NTC sensor located on the compressor shell with power to the compressor removed when a selected temperature threshold (trip temperature) is exceeded. As in the case of the overcurrent failure mode, power to the fan motors is independently controlled. The programmed trip temperature is dependent on the particular compressor motor employed.

The IRC module adaptively controls the refrigerator defrost cycle to minimize system energy usage and maintain evaporator coil efficiency. As will be explained in detail below, an algorithm takes into account previous defrost cycle run times (i.e., defrost cycle duration). The module controls when power is applied to the defrost heater based on these times and a temperature signal from a thermistor located near the evaporator coil. The defrost cycle preferably begins when a call for cooling occurs to take advantage of warmer compartment temperatures.

The module provides protection against shorted or open sensor failures. It can detect an open or short circuit condition on any of the three sensor inputs and is capable of de-energizing the compressor, fan motors and the defrost heater. The IRC module will run in a default operating mode in the event of failure of the freezer or defrost sensors. In the event of a failure of the compressor sensor, the IRC module will de-energize the compressor, fan motors and the defrost heater. To prevent rapid compressor cycling in cases where a fault condition is detected and then quickly disappears, the module enters a tripped state and remains in that state for a minimum period of time before resuming operation.

Figure 4A:
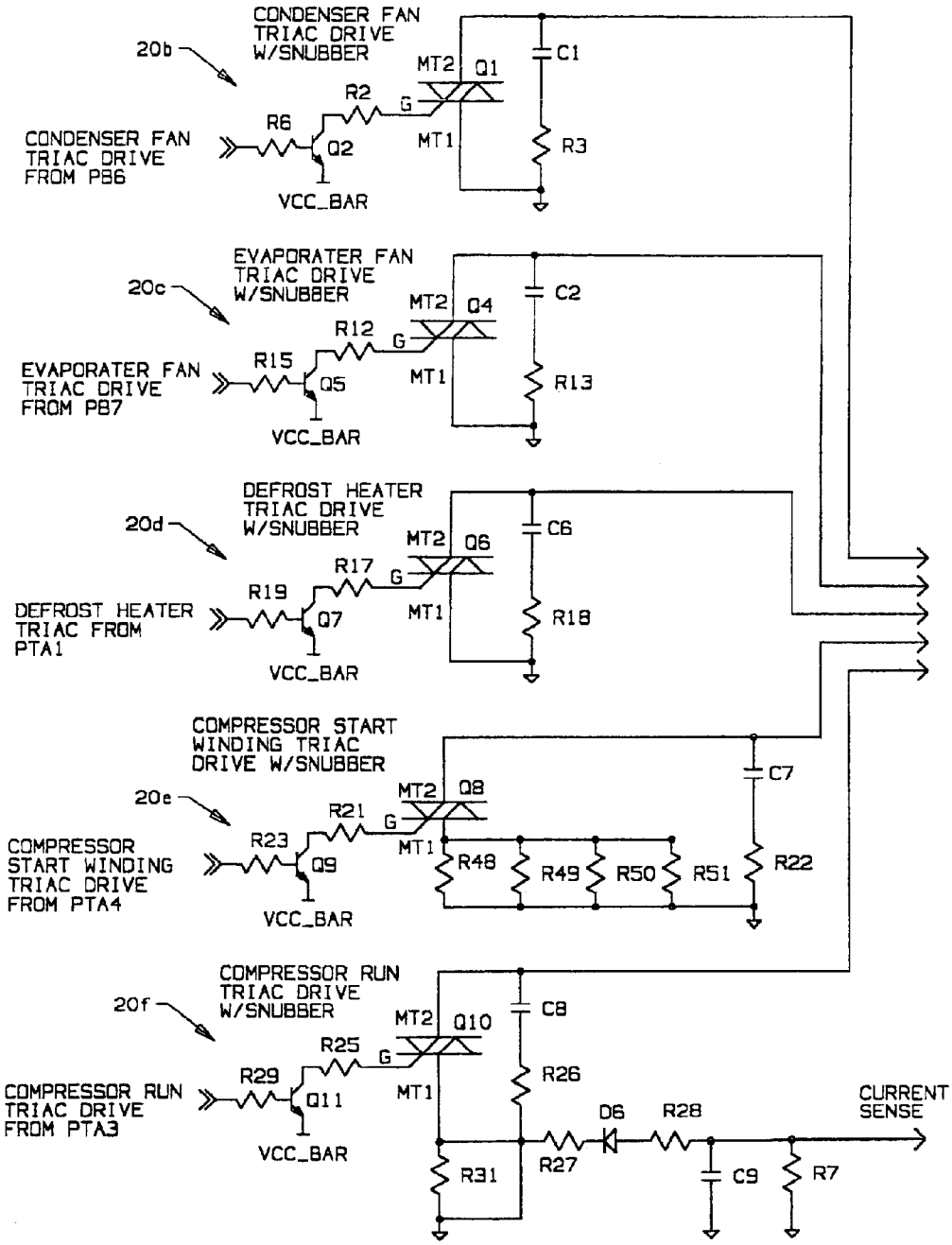
Figure 4B:
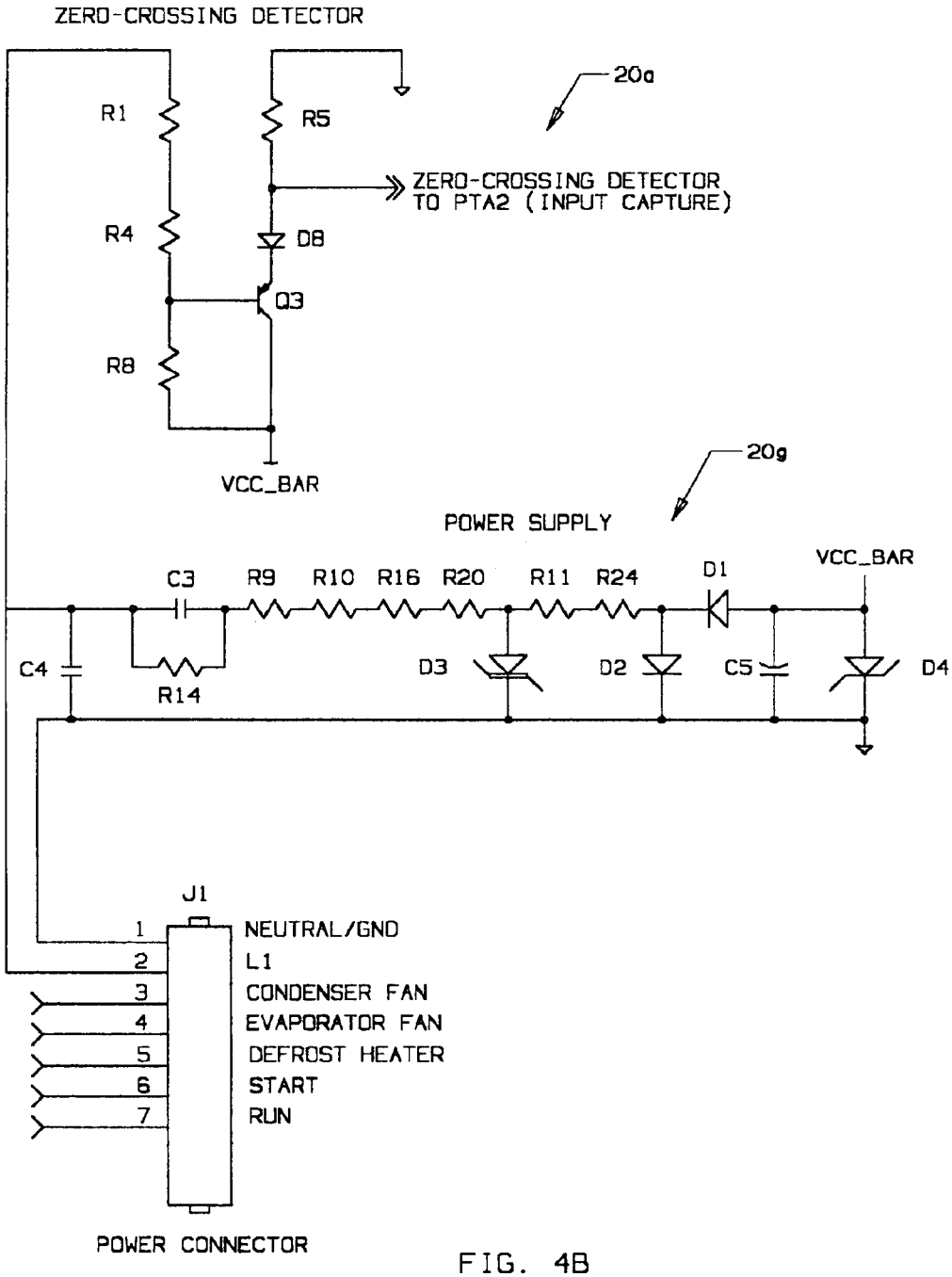
Figure 5:
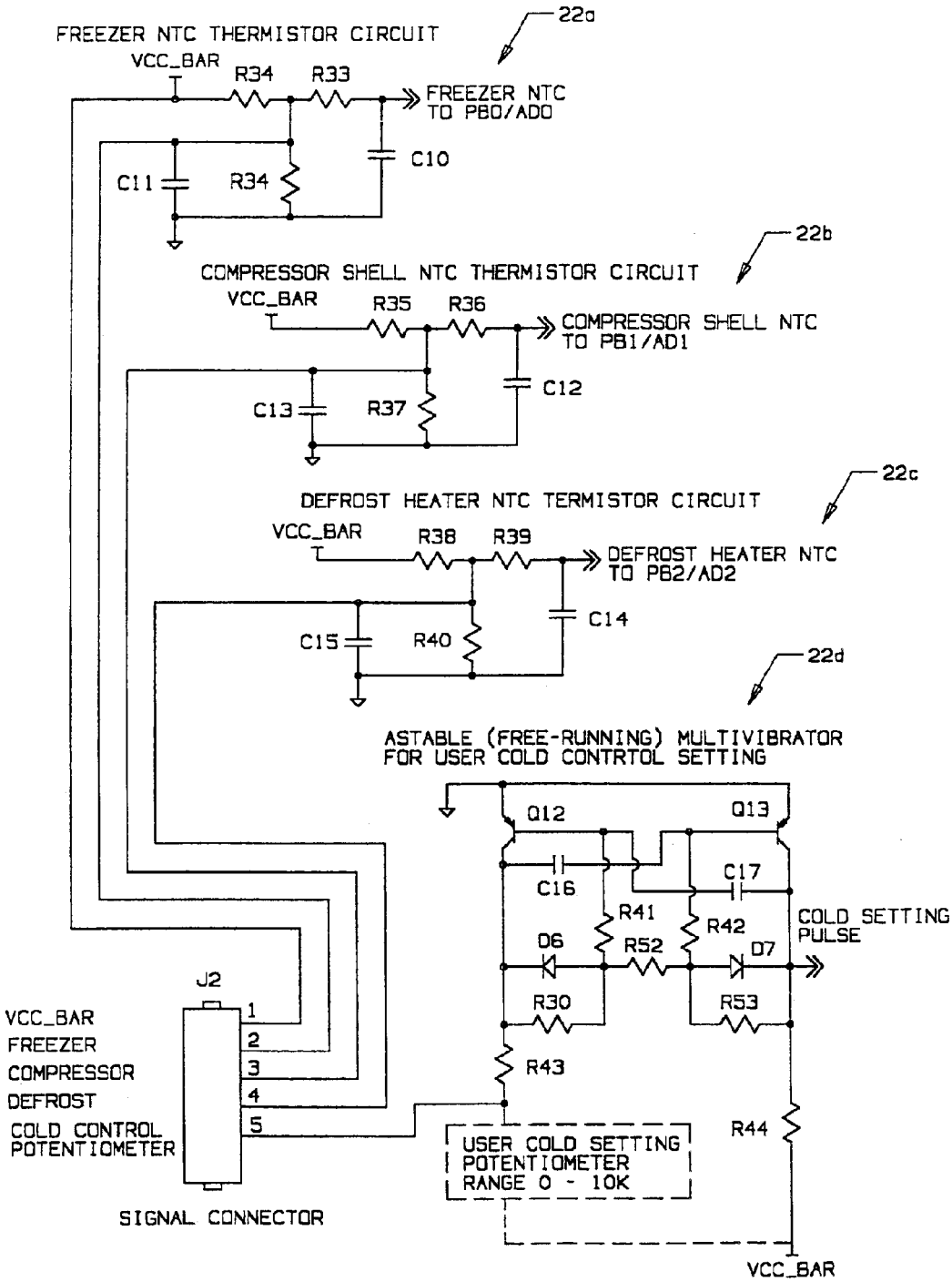
FIG. 5 shows a schematic wiring diagram of a signal connector and interconnected thermistor circuits and a cold control circuit.

In the embodiment described, power to the start and run windings, the evaporator fan, the compressor fan and the defrost heater are all controlled by the IRC module through electronic switches, in the specific embodiment described, triacs. With reference to FIGS. 4A, 4B and 5, triacs Q1 of triac network 20*b*, Q4 of triac 20*c*, Q6 of triac network 20*d*, Q8 of triac network 20*e* and Q10 of triac network 20*f* are connected respectively, to power connector J1 through the compressor fan, evaporator fan, defrost heater, start winding and run winding. A zero-crossing detector network 20*a* is also connected through power connector J1 to line current and neutral.

With respect to triac networks 20*b*–20*f*, the triacs are operated in quadrants 2 and 3 and thus are provided with a negative supply VCC_Bar and with terminal MT1 of each triac connected directly to neutral and terminal MT2 connected to the respective load. The triac networks are interfaced with microprocessor U1 through an output pin on the microprocessor. In the case of network 20*b*, the output from microprocessor U1 is received at the base of NPN transistor Q2 through resistor R6 selected to saturate the transistor. The emitter of transistor Q2 is connected to negative voltage VCC_BAR and the collector is connected to the gate of triac Q1 through resistor R2 selected to provide a suitable current value. Microprocessor U1 provides a high signal which biases transistor 02 on with current flowing from the gate through resistor R2 until the signal goes low turning off the transistor current at the gate of triac Q1 but current flowing from terminals MT2 to MT1 remains above the holding current to keep the triac on for the remainder of the half cycle. Capacitor C1, serially connected to resistor R3 across the main terminals of the triac, is optional and serves as a snubber, or filter to provide transient switching noise protection.

Triac networks 20*c*–20*e* operate in a corresponding manner. With respect specifically to triac network 20*f*, the compressor run triac, a current sense resistor R31 is placed in series with terminal MT1 and neutral and is chosen with a sufficiently low value that its voltage potential does not adversely affect the gating operation or the operation of the load. This provides a means for sensing current through resistors R27, R28 and diode D5 so that should the current rise above a selected threshold microprocessor U1 can de-energize the compressor.

Zero-crossing network 20*a* comprises resistors R1, R4 and R8 connected as a voltage divider between line L1 and VCC_BAR with the base of PNP resistor Q3 connected between resistors R4, R8. The collector of transistor Q3 is connected to the negative reference VCC_BAR and the emitter to the cathode of diode D8 whose anode is connected to resistor R5 in turn connected to neutral. The junction between the anode and resistor R5 is fed into a timer input capture pin TCHO of microprocessor U1. The circuit provides a square wave from a 60 Hz line voltage. The use of transistor Q3 and diode D8 provides suitable noise immunity as well as the desired square wave.

Power supply network 20*g* comprises capacitor C3 connected to line power source L1. The capacitance of C3 determines the maximum value of current the supply can provide. Resistor R14 is connected in parallel with capacitor C3 while resistors R9, R10, R16, R20, R11, R24 and rectifying diode D1 are serially connected to capacitor C3 providing negative reference VCC_BAR through zener diode D4. Transient overload protection is provided by protective device D3 and EMI (electromagnetic immunity) protection is provided by capacitor C4. Capacitor C5 serves to store energy between the times when capacitor C3 is delivering energy.

FIG. 5 includes thermistor networks 22*a*, 22*b* and 22*c* as well as a multivibrator network 22*d* connected to signal connector V2 connecting the networks to respective NTC thermistors in the case of 22*a*–22*c*, and cold control potentiometer 16 in the case of network 22*d*.

Thermistor networks 22*a*–22*c* are used to translate NTC resistance into a voltage usable by the microcontroller. Referring to network 22*a*, resistor R32 is placed in parallel with the freezer thermistor, and the pair is connected in series between VCC_BAR and resistor R34. Resistor R32 acts as a linearizing resistor and resistor R34 defines the middle of the range whose resultant behavior is linearized. This orientation, given a positive VCC_BAR, results in a positive change in voltage for positive change in temperature, and the slope of this voltage-to-temperature curve is linear with constant slope over a range of approximately 40 degrees Celsius. Resistor R33 is connected in series between an analog input pin of the microcontroller and the node between resistors R32 and R34. Capacitor C10 is connected from the analog input pin to ground. Resistor R33 and capacitor C10 comprise a simple analog noise filter. Networks 22*b* and 22*c* perform the same function as network 22*a* for the compressor shell and defrost sensors.

Multivibrator network 22*d*, used for the cold control comprises PNP transistors Q12, Q13 whose bases are connected to their respective collectors through respective capacitors C17, C16 and whose emitters are connected to neutral. Serially connected resistors R41 and R30 are connected between the base of transistor Q12 and its collector while serially connected resistors R42, R53 are connected between the base of transistor Q13 and its collector. The cathode of diodes D6, D7 are respectively connected to the collectors of transistors Q12, Q13 and the anodes are respectively connected to opposite sides of resistor R52 and the nodes between resistors R41, R30 and R42, R53 respectively. Suitable resistors R43, R44 are connected between the collectors of respective resistors Q12, 013 and reference VCC_BAR. The circuit functions as an oscillator and by placing potentiometer 16 effectively in series with resistor R43 the frequency range can be divided into various settings, e.g., setting 1 between 0 and 1 KHz and setting 2 between 1 and 2 KHz. The collector of transistor Q13 is connected to PTAO/KBDO of microprocessor U1 configured as an interrupt so that the edges of the square wave output of the circuit are counted within a time period in order to determine the setting.

In the described embodiment, the multivibrator circuit allows the use of a lower cost microprocessor having four analog-to-digital converter inputs. Such inputs in the present system are used for analog inputs for compressor main winding current, freezer, compressor shell and defrost temperatures. It will be understood that it is within the purview of the invention to use a microprocessor having an additional A/D input and use that for a cold control potentiometer input.

For each desired temperature setting, a selected temperature at which the compressor is to be turned on and a corresponding selected temperature at which it is to be turned off is entered and stored in memory of microprocessor U1.

As noted above, the IRC module controls the temperature of the freezer compartment by means of two input signals, one corresponding to the temperature of the freezer compartment through sensor S1 and the other corresponding to the desired temperature sensor through potentiometer 16, a linear taper potentiometer which is user-adjustable rotary knob typically situated in the freezer compartment. The freezer compartment temperature is controlled by comparing the actual freezer temperature to the desired setting. If the temperature rises higher than the setting, the IRC module independently energizes the compressors main winding and start winding. Preferably, the IRC module then de-energizes the start winding after a selected period. It will be understood that it is within the purview of the invention to use a conventional motor starting relay or PTC starter, if desired. The IRC module then de-energizes the main winding when the desired temperature is reached. Power is independently provided by the IRC module to the evaporator fan and the compressor fan.

The IRC module provides protection for the compressor motor by sensing the current flowing through the main compressor winding and de-energizing the motor once certain fault conditions are detected. The current overload threshold is stored in memory of microprocessor U1 and is calibrated by selecting a suitable value such as the Must Hold Amperes (MHA) rating for the compressor.

Sensor S3 located on the compressor shell is monitored and power is removed from the compressor by the IRC module when a selected "trip" temperature is exceeded to avoid excessive motor temperatures. As noted above, the IRC module independently controls power to the fan motors even in the tripped state. Trip temperature selection is compressor dependent and is determined for each specific motor application. When an acceptable motor winding temperature has been restored and the resistance of S3 returns to a selected reset level, power is restored after a minimum trip time.

In accordance with the preferred embodiment, the IRC module adaptively controls the refrigerator defrost cycle to minimize system energy and maintain evaporator coil efficiency. The algorithm measures the previous defrost cycle ON time and calculates the length of the following compressor run time before the next defrost cycle. After a power reset, the IRC module initiates a standard time/temperature defrost cycle after a default amount of compressor run time (defrost OFF time) has elapsed. Upon conclusion of the defrost cycle, the new amount of cumulative compressor run time (defrost OFF time) is calculated using the following equation:

$$y=a*[1-(x/k)]$$

where y is defrost OFF time, the new amount of required compressor run time before the start of the next defrost cycle, a is maximum defrost OFF time, the longest allowable amount of compressor run time between defrost cycles, x is actual defrost ON time, the amount of time the defrost heater was energized in the most recent cycle, k is the maximum defrost ON time, the longest allowable amount of time the defrost heater may be energized per defrost cycle. In effect this takes the ratio of the previous actual defrost ON time to the maximum allowable defrost ON time and using that ratio multiplying it by the maximum allowable defrost OFF time and subtracting that result from the maximum allowable defrost OFF time to determine the next defrost OFF time.

The constants, a and k, along with the minimum defrost OFF time are stored in memory of microprocessor U1 so that during operation the only variable in the equation is the previous defrost ON time. The refrigerator manufacturer chooses the constants of maximum and minimum compressor run time (defrost OFF time) as well as the minimum and maximum defrost ON time.

The minimum and maximum defrost ON times along with a default slope determined by maximum defrost OFF time divided by minimum defrost OFF time provide manufacturers with the means to control the defrost system of the refrigerator in the manner they see fit. The slope term can also be a value other than this quotient, such that the MTBD (mean time between defrosts) is longer or shorter than it would be using the default slope term. The IRC module can be programmed to ensure that maximum and minimum values are not violated, if so desired.

As noted above, defrost cycles are initiated at the end of a warming cycle in order to take advantage of ambient warming effects and thereby shorten defrost times. That is, a defrost cycle is initiated upon the first call for cooling following the completion of the defrost OFF time.

In a modified embodiment, preventive defrost cycles are performed. By running the defrost heater at the same or reduced power levels for short periods of time relative to a full defrost cycle during a cumulative compressor run time, the build-up of frost is reduced and cooling efficiency losses are minimized. In a preferred modified embodiment, the defrost OFF time calculated by the defrost equations is divided into a selected number of intervals and at the beginning of each interval, a preventive defrost is preformed. For example, for a newly calculated defrost OFF time of 20 hours and a preselected number of intervals of 5, the defrost heater is energized once every four hours of cumulative compressor run time for 2 minutes at the same or a portion of full energy level. In the case of reduced energy level, the defrost heater triac Q6 can be operated, for example, in only one quadrant to supply half the normal energy level. It will be understood that, if desired, other triac firing angles can be employed to vary the heater energy level.

Alternatively, a preventive defrost could be initiated when the difference between the temperature of sensor S2 and the freezer compartment (S1) exceeds a chosen threshold or when the main compressor run time for a selected number of cooling cycles exceeds a selected threshold.

Figure 6:
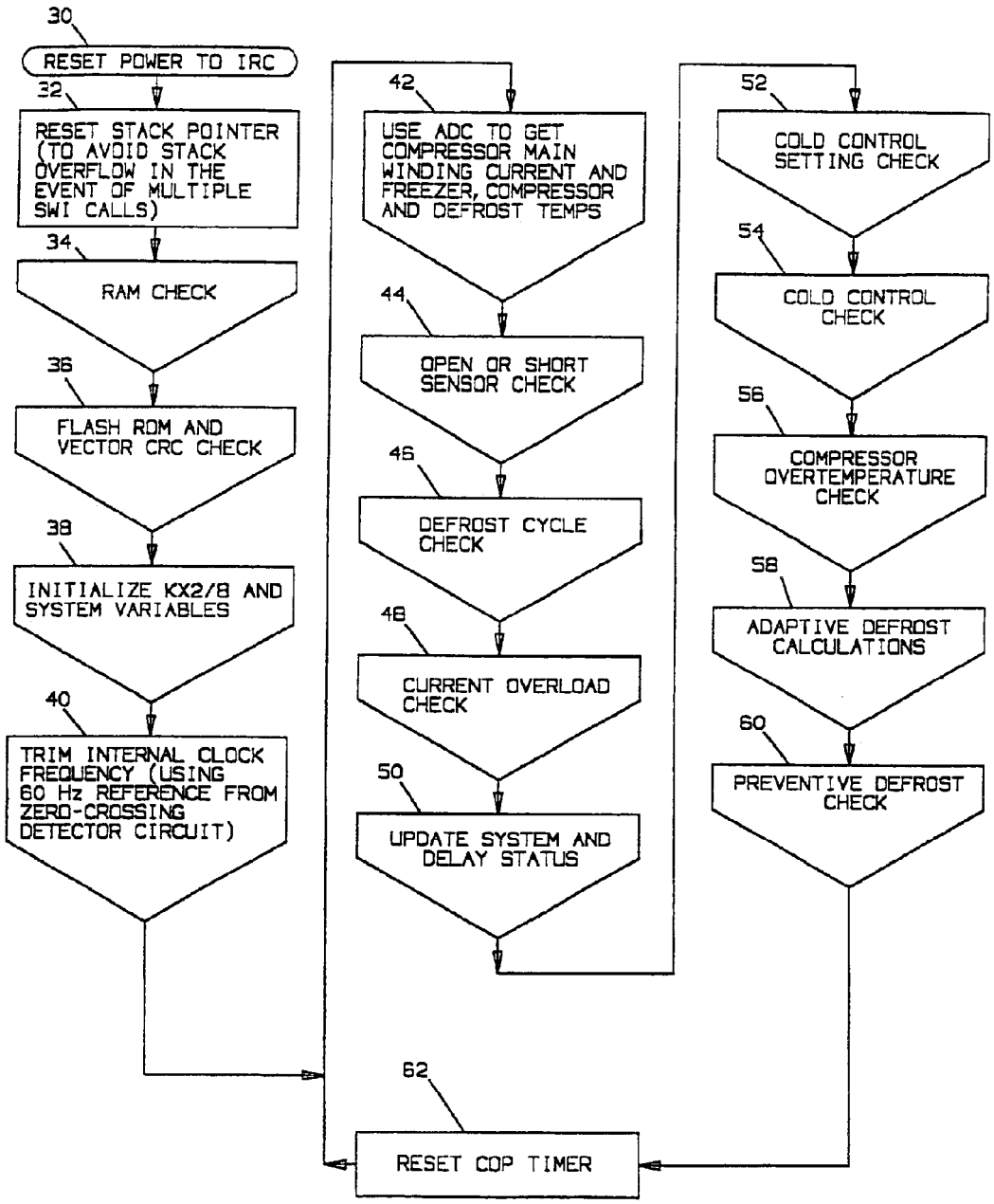
FIGS. 6–8 are flow charts relating to the operation of the system.
Figure 7:
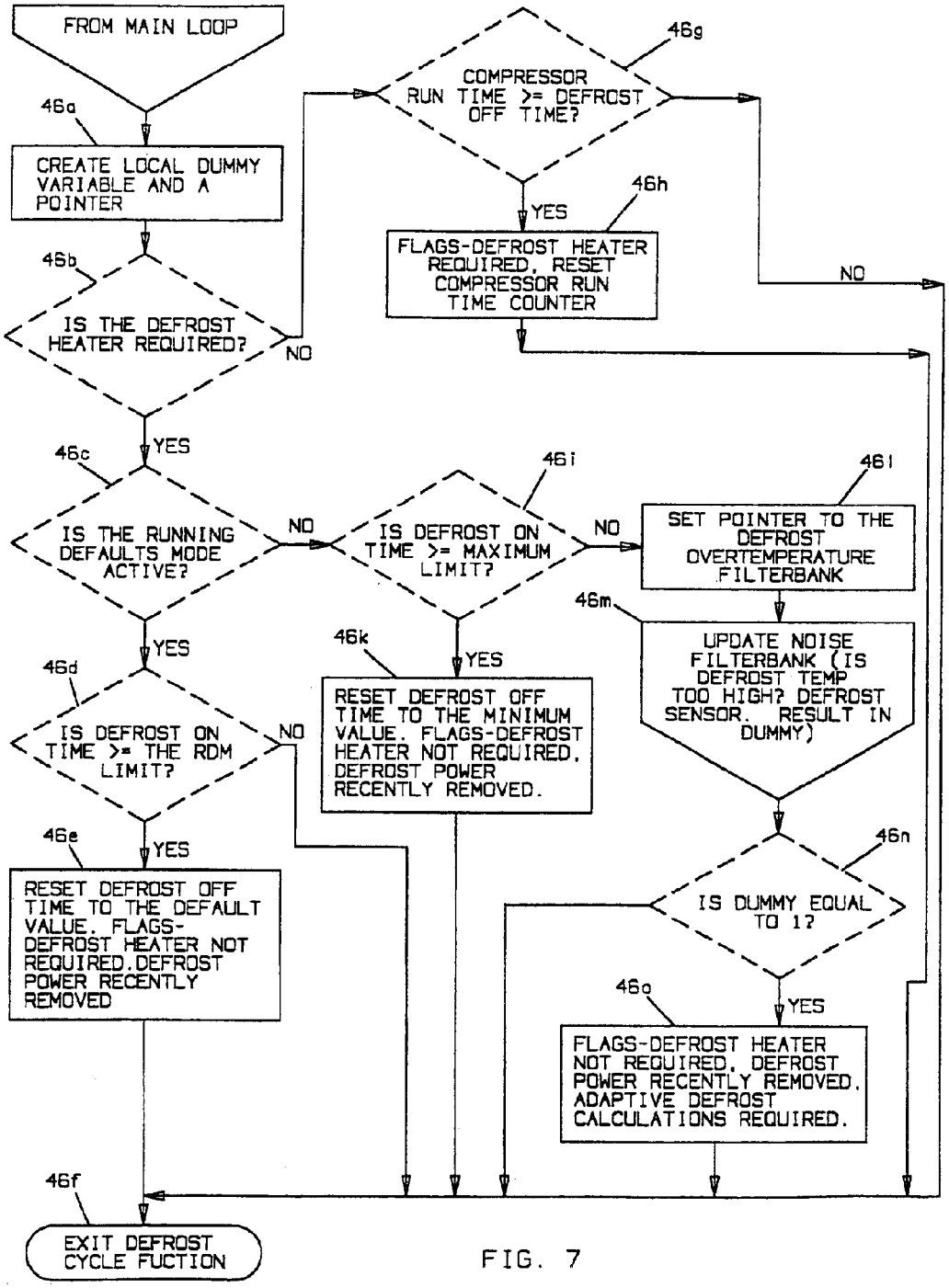

The main loop of the flow chart is shown in FIG. 6 in which step 30 resets power to the IRC module, step 32 resets the stack pointer and steps 34–40 perform various system checks, initializes microprocessor U1 and system variables and trims the internal clock. At step 42, the A/D converter gets values of compressor main winding current and freezer, compressor and defrost temperatures. Open or short sensor checks are performed at step 44 and a defrost cycle check at step 46. Step 46 includes a subroutine shown in FIG. 7 including creating a local dummy variable and pointer at step 46*a*, determining whether energization of the defrost heater is required at decision step 46*b*, and if so determining if the running default mode is active at 46*c*. If the default mode is active, determining at decision step 46*d* if the defrost ON time is greater than or equal to the RDM (Running Default Mode) limit. If affirmative, the defrost OFF time is reset to the default value at process step 46*e* and then the routine exits the defrost cycle check functions at 46*f*. Going back to decision step 46*b*, if the defrost heater is not required the subroutine goes to decision step 46*g* to determine if the compressor run time is greater than or equal to the defrost OFF time and if not onto exit step 46*f* but if the decision is affirmative then the subroutine goes to process step 46*h* to reset flags calling for energization of the defrost heater and resetting the compressor run time counter and then to exit step 46*f*.

With reference to decision step 46*c*, if the running default mode is not active, the routine goes to decision step 46*i* to determine if defrost ON time is greater than or equal to the maximum limit. If so, the routine goes to step 46*k* to reset the defrost OFF time to the minimum value and then onto exit step 46*f*. If the defrost ON time is not greater than or equal to the maximum limit at step 46*i*, the routine goes to step 461 to set a pointer to the defrost over-temperature filterbank and then to step 46*m* to update the noise filterbank. The routine then goes to decision step 46*n* to determine whether the dummy is equal to 1 and if not onto exit step 46*f* and if affirmative onto step 46*o* setting flags for adaptive defrost calculation and then to exit step 46*f*.

Figure 8:
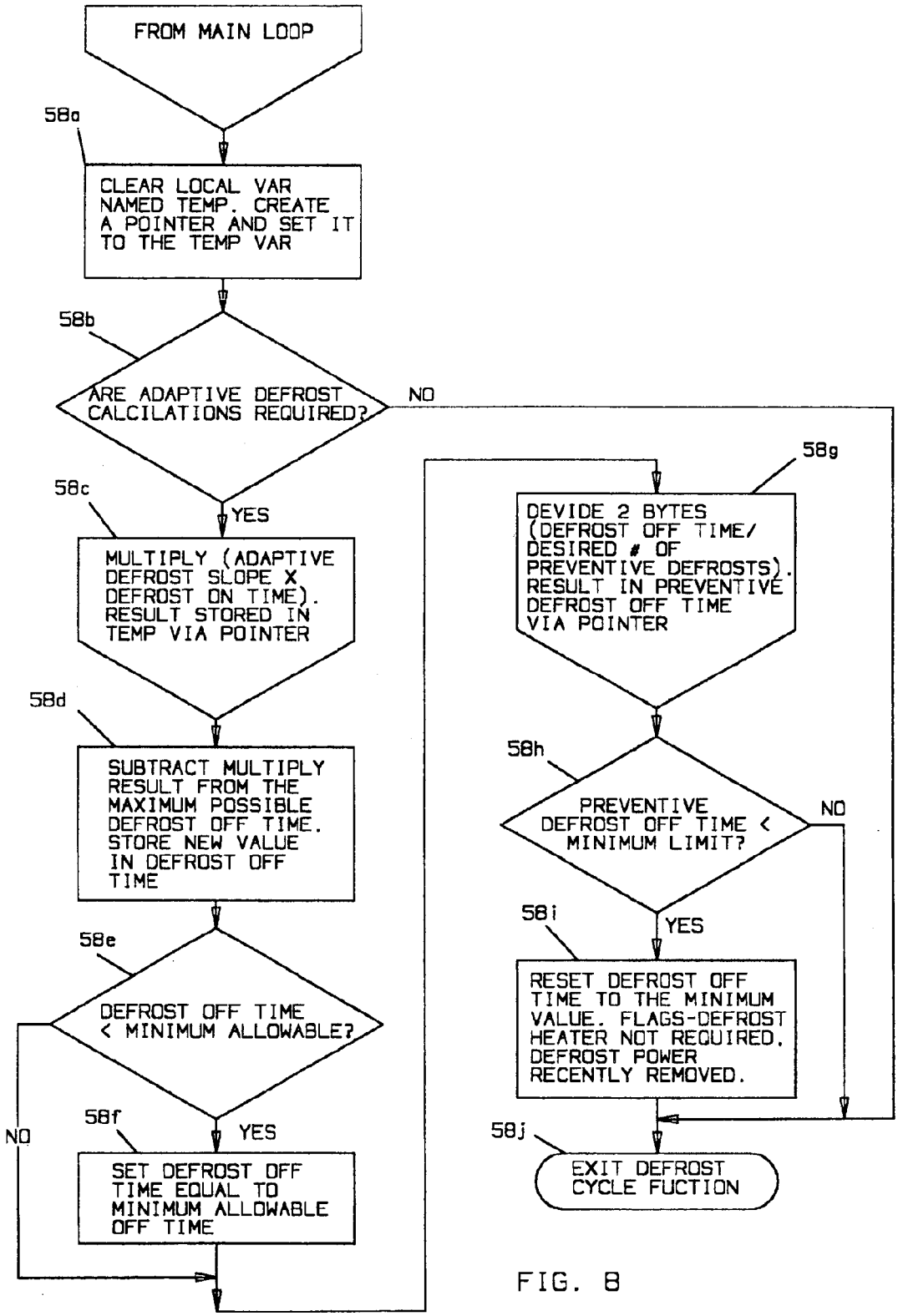

Following step 46 of the main routine (FIG. 6), current overload is checked at step 48 and at step 50 system and delay status is updated. The cold control and setting are checked at steps 52, 54 and the compressor over-temperature is checked at step 56. Adaptive defrost calculations are performed at step 58 which is shown as a subroutine in FIG. 8. At step 58*a* of the subroutine, the local variable named temperature is cleared and a pointer is created and set to the temperature variable. Decision step 58*b* looks to see if adaptive defrost calculations are required and if not, goes directly to exit stop 58*j* but if they are required, then it goes to step 58*c* and performs a multiplication of the adaptive defrost slope by the defrost ON time and stores the result in temperature via a pointer. At step 58*d*, the result of step 58*c* is subtracted from the maximum possible defrost OFF time with the result stored in defrost off time. Decision step looks to see if the defrost OFF time is less than the allowable minimum time and if not, goes directly to exit step 58*j*. In the first described embodiment, i.e., the embodiment without preventive defrost. If the defrost OFF time of step 58*e* is less than the minimum, then at step 58*f*, the defrost OFF time is set to the minimum allowable OFF time and then the routine goes on to exit step 58*j*.

In the modified embodiment, steps 58*e* and 58*f* lead to step 58*g* when the defrost OFF time is divided by the number of selected preventive defrosts. Decision step 58*h* looks to see if the preventive defrost OFF time is less than the minimum limit and if not, goes on to exit step 58*j* and if it is less than the minimum limit, the defrost OFF time is reset at step 58*i* to the minimum value and then on to exit step 58*j*.

Following step 58, in the main routine, a preventive defrost check is performed at step 60 and then the routine goes to step 62 resetting the COP timer and then looping back to step 42.

Thus, in accordance with the invention, an improved efficient refrigeration system is provided in which the defrost heater is energized directly at times determined adaptively by the previous defrost on time by an electronic switch such as a triac to provide any of the various selected energy levels at times which are more responsive to changing environmental conditions then in prior art systems and obviates the use of conventional electronmechanical switches.

While the invention has been particularly shown and described above with reference to preferred embodiments, the foregoing and other changes in form and detail may be made by one skilled in the art without departing from the spirit and scope of the invention.

What is claimed:

1. A refrigeration control for a refrigeration system having a compressor, an evaporator, a freezer compartment and a defrost heater comprising a microprocessor, a first temperature sensor thermally coupled to the freezer compartment, the first temperature sensor having a first temperature responsive electrical signal fed to the microprocessor, a second temperature sensor thermally coupled to the evaporator, the second temperature responsive sensor having a second temperature responsive electrical signal fed to the microprocessor, the system being operated in a refrigeration cycle having a cooling mode and a defrost mode, the compressor being connected to line voltage when the temperature of the first temperature sensor rises above a first threshold to operate in the cooling mode for a cumulative compressor run time, an electronic switch for connecting the defrost heater to a voltage source and a zero-crossing detector network coupled to the voltage source and having an input to the microprocessor, the microprocessor programmed to monitor the first and second temperature responsive signals and based upon such signals and zero-crossing detection to energize the electronic switch to provide power to the defrost heater for a defrost cycle, the cumulative compressor run time of a given refrigeration cycle being determined by the length of time the defrost heater was energized in the immediately preceding defrost cycle.

2. A refrigeration control according to claim 1 in which the electronic switch is a triac.

3. A refrigeration control according to claim 2 in which the triac is operated in the second and third gating quadrants of operation.

4. A refrigeration control according to claim 2 in which the control varies the phase angle at which the triac is energized and de-energized to vary the energy level of the defrost heater at selected times.

5. A refrigeration control according to claim 2 in which the defrost heater is energized for brief preventive defrost periods during intervals of compressor run time within a refrigeration cycle.

6. A refrigeration control according to claim 5 in which the triac is energized and de-energized at different phase angles for the defrost cycle relative to the preventive defrost periods to vary the energy level of the defrost heater.

* * * * *